US008993048B2

(12) United States Patent
Arndt et al.

(10) Patent No.: US 8,993,048 B2
(45) Date of Patent: Mar. 31, 2015

(54) METHOD FOR PRODUCING A LAYER BY MEANS OF COLD SPRAYING AND USE OF SUCH A LAYER

(75) Inventors: Axel Arndt, Berlin (DE); Christian Doye, Berlin (DE); Oliver Stier, Berlin (DE); Raymond Ullrich, Schönwalde (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/701,152

(22) PCT Filed: May 31, 2011

(86) PCT No.: PCT/EP2011/058919

§ 371 (c)(1),
(2), (4) Date: Feb. 6, 2013

(87) PCT Pub. No.: WO2011/151313

PCT Pub. Date: Dec. 8, 2011

(65) Prior Publication Data

US 2013/0142950 A1 Jun. 6, 2013

(30) Foreign Application Priority Data

May 31, 2010 (DE) ..... 10 2010 022 597

(51) Int. Cl.
*B05D 1/12* (2006.01)
*C23C 4/00* (2006.01)
*C23C 24/04* (2006.01)

(52) U.S. Cl.
CPC .. *B05D 1/12* (2013.01); *C23C 24/04* (2013.01)
USPC ..... 427/192; 427/190; 427/191

(58) Field of Classification Search
USPC ..... 427/190–192, 427
See application file for complete search history.

(56) References Cited

U.S. PATENT DOCUMENTS 6,365,222 B1 * 4/2002 Wagner et al. ..... 427/140
6,669,997 B2 * 12/2003 Luan et al. ..... 427/601

(Continued)

FOREIGN PATENT DOCUMENTS

DE 19747386 4/1999
DE 102004043914 3/2006

(Continued)

OTHER PUBLICATIONS

R. S. Lima et al., "Microstructural characteristics of cold-sprayed nanostructured WC-Co coatings," Thin Sold Films, vol. 416, 2002, pp. 129-135.

(Continued)

*Primary Examiner* — Frederick Parker
(74) *Attorney, Agent, or Firm* — Staas & Halsey LLP

(57) ABSTRACT

A method generates an abrasive wear-resistant layer on a substrate. The layer is formed of particles of a ductile material, in particular Zn, wherein the parameters of the cold spraying process are set such that a comparatively loose laminate having pores is formed by the spray particles. The laminate advantageously and surprisingly exhibits high resistance to abrasive wear (for example by a particle) because the layer can avoid the attack by the particle by plastic deformation and closure of the pores, whereby abrasive removal of the layer is advantageously low. The cold gas-sprayed layer is used as a protective layer against abrasive wear.

13 Claims, 5 Drawing Sheets

(56) References Cited

U.S. PATENT DOCUMENTS

| | | | | |
|---|---|---|---|---|
| 6,706,319 | B2 * | 3/2004 | Seth et al. | 427/190 |
| 7,479,299 | B2 * | 1/2009 | Raybould et al. | 427/191 |
| 2007/0240603 | A1 | 10/2007 | Ko et al. | |
| 2012/0121431 | A1 | 5/2012 | Jakimov et al. | |

FOREIGN PATENT DOCUMENTS

| | | |
|---|---|---|
| DE | 10 2010 022 597.5 | 5/2010 |
| EP | 1897972 | 3/2008 |
| EP | 1903127 | 3/2008 |
| EP | 1921181 | 5/2008 |
| EP | 2072634 | 6/2009 |
| EP | 2011/058919 | 5/2011 |
| WO | 2005/079209 | 9/2005 |
| WO | 2011/015187 | 2/2011 |

OTHER PUBLICATIONS

Eugene G. Leuze Verlag, "Kaltgasspritzen: Revolutionäre Lösungen durch neue Beschichtungstechnologie," Galvanotechnik Dec. 2003, 3pp.

Von J. Vlcek et al., "Industrial Application of Cold Spray Coatings in the Aircraft and Space Industry," Galvanotechnik Mar. 2005, pp. 684-699.

German Office Action for German Priority Patent Application DE 10 2010 022 597.5, issued on Mar. 7, 2011.

International Search Report for PCT/EP2011/058919, mailed on Jun. 29, 2011.

* cited by examiner

METHOD FOR PRODUCING A LAYER BY MEANS OF COLD SPRAYING AND USE OF SUCH A LAYER

CROSS REFERENCE TO RELATED APPLICATIONS

This application is based on and hereby claims priority to International Application No. PCT/EP2011/058919 filed on May 31, 2011 and German Application No. 10 2010 022 597.5 filed on May 31, 2010, the contents of which are hereby incorporated by reference.

BACKGROUND

The invention relates to a method for generating a layer that is resistant to abrasive wear, on a workpiece by cold gas spraying.

The production of a layer that is resistant to abrasive wear is described, for example, by R. S. Lima et al., "Microstructural Characteristics of Cold-Sprayed Nanostructured WC-Co Coatings", Thin Solid Films 416 (2002), pages 129-135. The layer described there has a fine microstructure, which is referred to as a nanostructured WC-Co coating.

This can be deposited on a substrate by cold gas spraying, a high degree of hardness, and consequently a high resistance to abrasive wear, being obtained because of the WC component of the microstructure.

However, the wearing of a hard layer such as this is primarily dependent on how hard the particles in the abrasive medium are. If the abrasive medium itself has a hardness similar to WC, comparatively high abrasive wear can likewise be found when wear-resistant layers containing WC are used.

SUMMARY

One possible object is to provide a method for generating a layer resistant to abrasive wear by which layers that have a comparatively high abrasive wear resistance can be generated.

The inventors propose a method for generating a layer that is resistant to abrasive wear, on a workpiece by cold gas spraying. In the method, particles are accelerated toward the surface of the substrate to be coated and remain adhering to the substrate at the point of impingement. In this way, a cold-gas-sprayed layer is created. The inventors also proposed a use of such a porous layer. Preferably used for the cold gas spraying, which is also referred to as kinetic spraying, is a cold gas spraying installation, which has a gas heating device for heating a gas. Connected to the gas heating device is a stagnation chamber, which is connected on the outlet side to a convergent-divergent nozzle, preferably a Laval nozzle. Convergent-divergent nozzles have a converging portion and a diverging portion, which are connected by a nozzle neck. The convergent-divergent nozzle generates on the outlet side a particle jet in the form of a gas stream containing particles traveling at high speed, so that the kinetic energy of the particles is sufficient for them to remain adhering on the surface to be coated.

According to the inventors' proposals, the particles are formed of Zn and/or Sn and/or Cu and/or Al and/or Ti and/or an alloy containing at least one of these metals as a main constituent. Furthermore, the speed of the particles impinging on the substrate is set such that the layer formed by these particles is porous and the grain size of the layer structure corresponds substantially to the particle size. Consequently, the pores that form in the microstructure of the layer lie exactly between the particles, while the particles are largely preserved in their form by setting the process parameters during the cold gas spraying. The comparatively high porosity of the coating result has the effect of creating as it were a loose metal structure, the selected metals exhibiting a ductile behavior. If the resistant layer is subsequently exposed to particle erosion for example, there is initially a plastic deformation of the particles in the layer, which, though leading to a consolidation of the microstructure and a reduction in its porosity, ensures that only little material is removed from the layer as result of the attack by the abrasive particles. The exposure of the resistant layer to the action of the particles can therefore be referred to as a kind of micro-forging, the plastic deformation of the particles in the microstructure of the resistant layer having the effect that material removal is largely avoided.

Herein there lies a surprising effect, which underlies the porous layer produced with a high ductility. Instead of providing a wear-resistant layer with as high a hardness as possible, as specified by R. S. Lima et al., according to the present proposals an opposite approach is taken, specifically that of designing the resistant layer in such a way that exposure to the action of an abrasive medium allows the deformation of the layer, in order to prevent abrasive wear of this layer by plastic yielding of the layer particles concerned.

According to an advantageous refinement, it is provided that the particles have an average particle size of 1 to 10 μm, preferably 2 to 5 μm. For the purposes of this discussion, particle size should be understood as meaning the average diameter of the particles, which can be statistically determined by known methods. Particles that are not round also have such an average diameter, and so their particle size can be specified. The choice of relatively fine particles advantageously leads to a microporosity of the layer, so that these particles can withstand particle erosion particularly effectively by plastic deformation of the porous particle composite on the basis of the mechanism described above.

According to another refinement, it is provided that, before the layer is applied, an adhesion promoting layer, in particular a layer of Ni, is applied to the substrate, having the effect of fixing the layer by forming common diffusion zones or intermetallic phases. This advantageously allows the adhesive bonding of the layer on the substrate to be improved by the formation of diffusion zones or intermetallic phases, in order that the exposure to the action of the abrasive medium does not lead to delamination of the layer. This measure also makes it possible in particular to apply the resistant layer to substrates that in themselves form a poor base for the metals selected. The resistant layer can then be deposited with good bonding on the adhesion promoting layer, which itself adheres well on the substrate.

Furthermore, the object specified at the beginning is achieved by a porous cold-gas-sprayed layer, which is formed of Zn and/or Sn and/or Cu and/or Al and/or Ti and/or an alloy containing at least one of these metals as a main constituent, being used as a protective layer on a workpiece to be protected from abrasive wear, pores being located between the cold-gas-sprayed particles. Such a use therefore involves the layer being produced on the workpiece concerned by cold gas spraying. By using the cold-gas-sprayed layer as specified, the advantages already mentioned above are achieved. As already mentioned, this involves taking the approach that a comparatively soft, ductile layer is used as the layer resistant to abrasive wear and not a hard wear-resistant layer, making use of the surprising effect that a soft, ductile layer can yield by plastic deformation to evade the attack by the abrasive medium, for which reason removal of material is advantageously reduced.

According to a refinement, it is provided that the workpiece formed of a metal or a metal alloy that is nobler than the material of the particles. In other words, the metal or the metal alloy of the workpiece should have a greater standard hydrogen electrode potential in the electrochemical voltage series than the material that constitutes the particles. This advantageously achieves the effect that the layer at the same time represents what is known as a cathodic corrosion protection for the substrate. Even if the layer is removed completely at some points of the workpiece by the advancing abrasive wear, the damaged layer still ensures corrosion protection since it then acts as a sacrificial anode. In other words, electrochemical attack on the workpiece is prevented by the less noble metal of the layer dissolving, whereby the material of the workpiece is protected.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
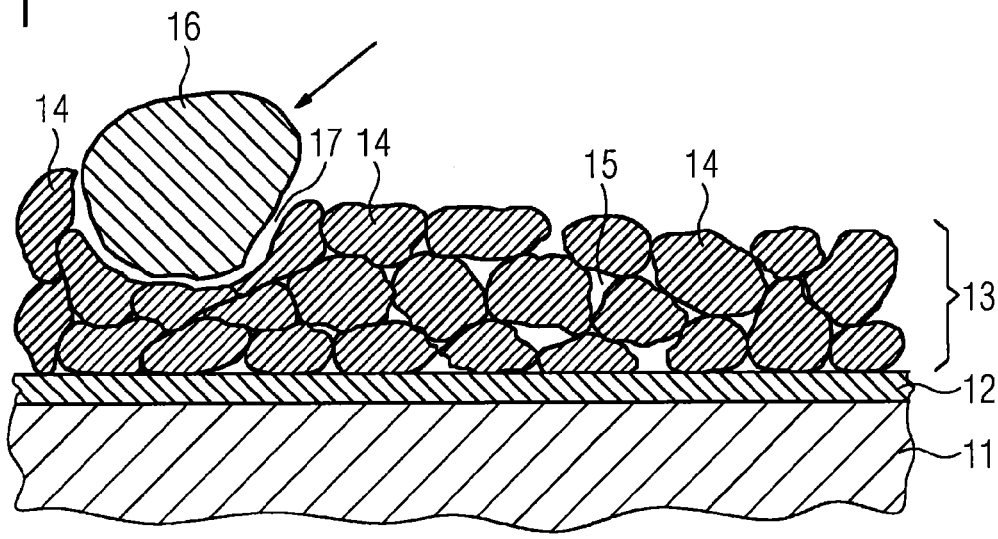
FIG. 1 shows a schematic section through an exemplary embodiment of the proposed layer and FIGS. 2 to 7 show plan views of the surface of an exemplary embodiment of the proposed layer; the various stages of wear of the surface represent particle erosion, respectively in a schematic form and in the form of photos.

Reference will now be made in detail to the preferred embodiments of the present invention, examples of which are illustrated in the accompanying drawings, wherein like reference numerals refer to like elements throughout.

On the basis of FIG. 1, the method of an exemplary embodiment of the proposed method can be presented. On a workpiece 11, an adhesion promoting layer 12, which is formed of nickel, has first been applied by cold gas spraying. Alternatively, this layer could also be applied electrochemically. In a further step, a resistant layer 13, which is formed of particles 14, is applied by cold gas spraying. These particles can still be clearly seen in their contour in the section according to FIG. 1, since the parameters of the cold gas spraying are set such that the particles 14 are scarcely deformed when they impinge on the workpiece 11 (substrate). However, the kinetic energy input into the particles is sufficient for them to remain adhering on the adhesion promoting layer 12 or on neighboring particles 14. Between the particles there form pores 15, which lead to a loose layer structure.

FIG. 1 also schematically depicts the mechanism of how the layer 13 responds to exposure to the action of an abrasive particle 16. The abrasive particle plastically deforms the particles 14 on which it acts, the pores between these particles at the same time being closed. This leaves a depression 17 in the form of a crater or scratch, although it does not have the effect that the material of the layer is removed, or only scarcely, but rather that it yields to the action of the abrasive particle 16 while undergoing plastic deformation.

Figure 2:
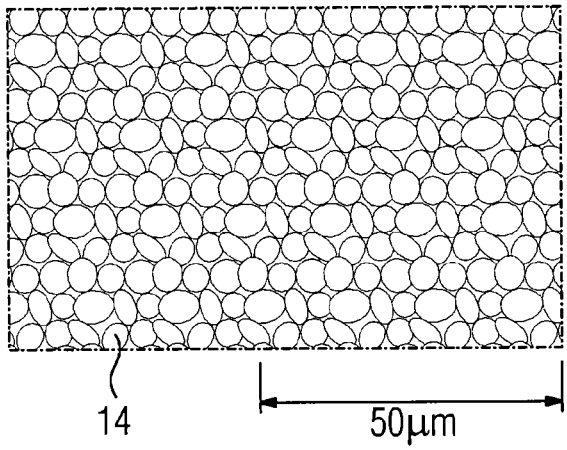
Figure 5:
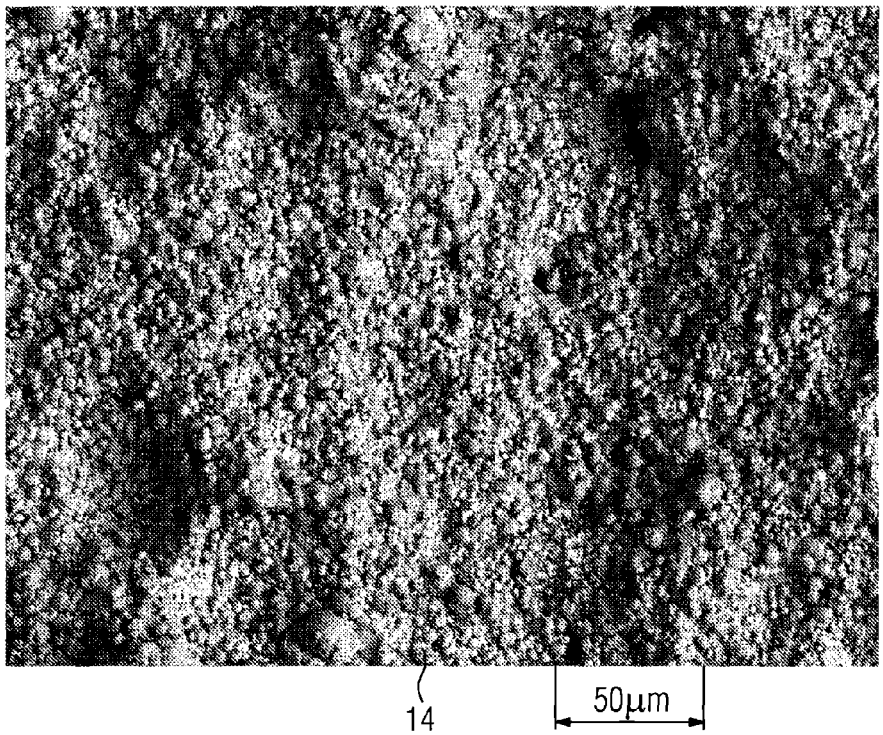

Using what is known as an HZO paint zinc dust, superfine, from the company Norzinco GmbH, with particle sizes of between 2 and 5 μm, a resistant layer was produced by cold gas spraying. The surface produced can be seen in FIG. 2 or 5. The particles 14 can still be seen on the surface, with pores between the particles also being discernible.

Figure 3:
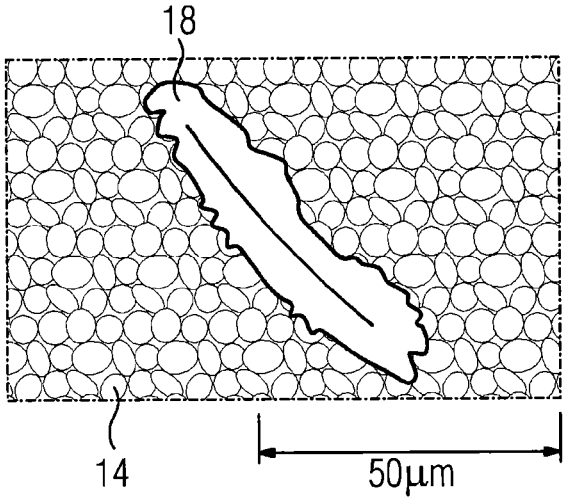
Figure 6:
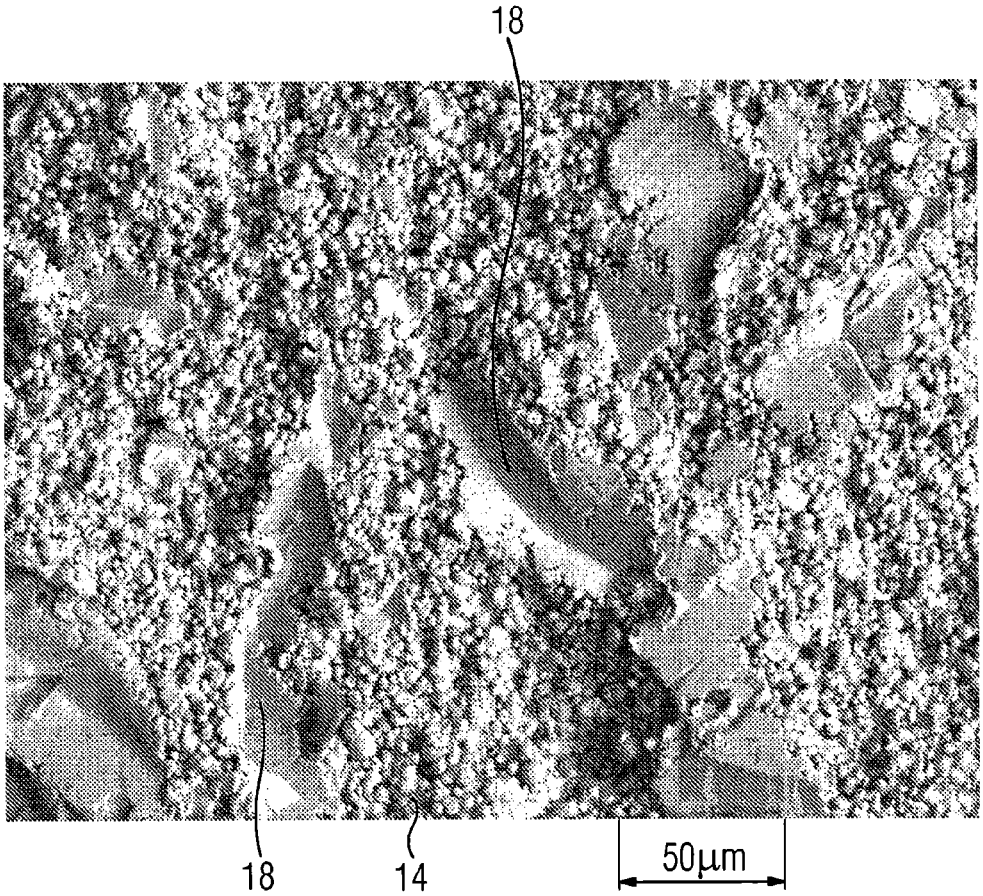

The layer surface generated was treated by sand blasting, using corundum with an average particle size of 120 μm. As can be seen from FIGS. 3 and 6, the first corundum particles 16, which graze the surface, cause scratches 18, which generate depressions 17, such as those schematically represented in FIG. 1.

Figure 4:
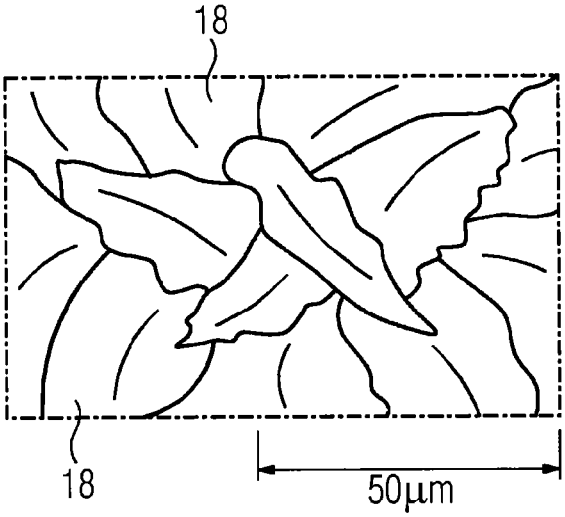
Figure 7:
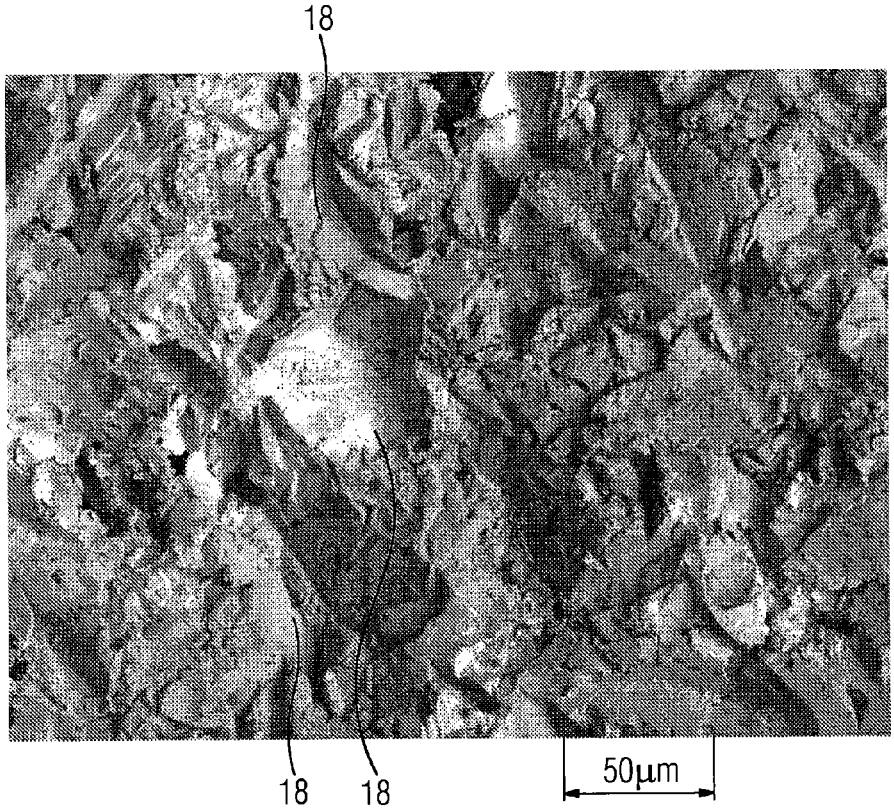

If the surface is exposed to sand blasting over a prolonged period of time, a surface image according to FIG. 4 or 7 is obtained. It is clear that the various scratches 18 that are generated by the corundum particles 16 overlay and overlap one another. It is clear from this that multiple plastic deformation of the material of the layer is also possible, even if the surface, formed of particles 14, is no longer recognizable in its original state after prolonged attack by the abrasive medium. Nevertheless, even in this stage of exposure, the abrasive removal of zinc is still relatively low.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide v. DIRECTV*, 69 USPQ2d 1865 (Fed. Cir. 2004).

The invention claimed is:

1. A method for forming a ductile, plastically deformable abrasion-resistant layer on a substrate, comprising:

forming the abrasion-resistant layer by accelerating particles having an average particle size of 1-10 μm by cold spraying the particles towards the substrate at a speed to cause the particles to impinge and adhere to the substrate and such that the formed abrasion-resistant layer is porous, wherein the cold sprayed particles are formed from a material selected from the group consisting of Zn, Sn, Cu, Al, Ti, and an alloy containing at least one of Zn, Sn, Cu, Al, and Ti as a main constituent, the formed abrasion-resistant layer has a grain size that corresponds substantially to the average particle size of the particles, and the porous abrasion-resistant layer withstands abrasive particle erosion by plastic deformation and reduction of porosity while remaining substantially intact.

2. The method according to claim 1, wherein the particles have an average particle size of 2 to 5 μm.

3. The method according to claim 1, further comprising, before the accelerating:

applying an adhesion promoting layer to the substrate to fix the abrasion-resistant layer by forming common diffusion zones or intermetallic phases.

4. The method according to claim 2, further comprising, before the accelerating:

applying an adhesion promoting layer to the substrate to fix the abrasion-resistant layer by forming common diffusion zones or intermetallic phases.

5. The method according to claim 3, wherein the adhesion promoting layer comprises Ni.

6. The method according to claim 4, wherein the adhesion promoting layer comprises Ni.

7. A method of using a porous cold-gas-sprayed layer, comprising:

protecting a workpiece from abrasive wear by applying a cold-gas-sprayed layer as a protective layer on the workpiece, the cold-gas-sprayed layer comprising particles formed from at least one material selected from the group consisting of Zn, Sn, Cu, Al, Ti, or an alloy containing one of Zn, Sn, Cu, Al, and Ti as a main constituent, wherein the cold-gas-sprayed layer is porous with pores located between the particles the particles have an average particle size of 1 to 10 μm, the abrasion-resistant layer has a grain size that corresponds substantially to a size of the particles, and the porous abrasion-resistant layer withstands abrasive particle erosion by plastic deformation and reduction of porosity while remaining substantially intact.

8. The method according to claim 7, wherein the particles have an average particle size of 1 to 10 μm.

9. The method according to claim 7, wherein the particles have an average particle size of 2 to 5 μm.

10. The method according to claim 7, wherein the workpiece comprises a metal or a metal alloy which is electrochemically nobler than the material of the particles.

11. The method according to claim 8, wherein the workpiece comprises a metal or a metal alloy which is electrochemically nobler than the material of the particles.

12. The method according to claim 9, wherein the workpiece comprises a metal or a metal alloy which is electrochemically nobler than the material of the particles.

13. The method according to claim 7, wherein the pores between the particles are substantially unfilled.

* * * * *